US006021806A

United States Patent [19]

Lee

[11] Patent Number: 6,021,806

[45] Date of Patent: Feb. 8, 2000

[54] SLURRY DISTRIBUTION SYSTEM FOR A CMP PROCESS IN SEMICONDUCTOR DEVICE FABRICATION

[75] Inventor: Seung-bae Lee, Suwon, Rep. of Korea

[73] Assignee: Samsung Electronics Co., Ltd., Suwon, Rep. of Korea

[21] Appl. No.: 09/062,719

[22] Filed: Apr. 20, 1998

[30] Foreign Application Priority Data

May 8, 1997 [KR] Rep. of Korea ..... 97-17739

[51] Int. Cl.[7] ..... F03B 11/00

[52] U.S. Cl. ..... 137/393; 137/395; 137/592

[58] Field of Search ..... 137/393, 592, 137/590, 395

[56] References Cited

U.S. PATENT DOCUMENTS

| | | | |
|---|---|---|---|
| 2,613,922 | 10/1952 | Gatchet | 137/395 |
| 2,624,070 | 1/1953 | McDermott | 137/592 |
| 3,060,954 | 10/1962 | Froetschner | 137/592 |

*Primary Examiner*—A. Michael Chambers

*Attorney, Agent, or Firm*—Jones Volentine, LLP

[57] ABSTRACT

A slurry distribution system for supplying slurry used in the planarization process of a wafer surface by chemical reaction is provided with a movable supply line having an open end which is maintained at a constant depth below the surface of the slurry in the slurry tank. The movable supply line penetrates the top of the tank and is supported for vertical movement in an opening in the top of the tank. The other end of the movable supply line is located outside the tank and is connected to a main supply line which leads to CMP equipment. A pleated flexible tubing allows the movable supply line to move vertically relative to the main supply line and the top of the tank. A position-controlling mechanism keeps the open end of the movable supply line at a predetermined distance below the top surface of the slurry in the tank as the top surface rises and falls, by moving the movable supply line vertically in accordance with the changing amount of slurry inside the tank. Keeping the open end of the movable supply line at a predetermined depth below the top surface of the slurry prevents distorted and lumped slurry residue which may be present at the bottom of the tank from entering the movable supply line.

14 Claims, 2 Drawing Sheets

SLURRY DISTRIBUTION SYSTEM FOR A CMP PROCESS IN SEMICONDUCTOR DEVICE FABRICATION

BACKGROUND OF THE INVENTION

1. Field of the Invention

The present invention relates to a slurry distribution system for a chemical-mechanical polishing (CMP) process performed during the fabrication of a semiconductor device, and more particularly, to a system for distributing slurry in which the slurry supply line moves up and down, such that the lower inlet point of the supply line is maintained at a predetermined distance below the top surface of the slurry in the slurry tank.

2. Background of the Related Art

Unevenness on the surface of a wafer is a serious problem, due to the high-integration and multiple layer structure of the circuit distribution of semiconductor devices. Therefore, in order to planarize or flatten the uneven wafer surface, leveling materials or methods such as SOG (Spin On Glass), Etch Back, Reflow, etc., were developed. However, these methods still do not completely remove the unevenness, and accordingly, such methods have given way to current chemical-mechanical polishing (CMP) techniques.

The CMP technology levels the surface of the wafer using chemical and physical reactions, wherein the wafer comes into contact with the surface of an elastic pad, and slurry is supplied so as to react chemically with the wafer surface. Therefore, relative movement between the polishing platen and wafer holder physically levels the uneven wafer surface.

Removal rates and uniformity are important criteria for effective CMP technology. Variables such as the processing conditions of the CMP equipment, the kind of slurry, and the kind of carriers, etc., greatly affect both the removal rate and uniformity. The pH of the slurry and its ion concentration also have an impact on the planarization process. The slurry can be one of two kinds, one for metal and one for oxide, and the slurry is stored in a slurry distribution system to be supplied during the planarization process.

FIG. 1 shows a conventional slurry distribution system for supplying the slurry into the CMP equipment, comprising a tank 11 for storing a certain amount of slurry, and a slurry supply line 12 penetrating through the top side of the tank 11 for supplying the slurry into the CMP equipment (not shown).

The slurry is supplied through the slurry supply line 12 into the CMP equipment, and is conventionally circulated by using either a pump, compressed nitrogen, or vacuum methods. The height H from a lower opening 12*a* of the slurry supply line 12 to the bottom of the tank 11 is generally less than 5 cm.

A return line 14 is installed penetrating the top of the tank 11, through which any excess slurry supplied to the CMP equipment, but not needed there, is returned to the tank 11. A supplementary line 15 from a slurry mixing tank (not shown) is connected to the return line 14 so as to additionally supply new slurry when necessary.

A plurality of level sensors are installed inside the tank 11 so that a certain amount of slurry is always kept therein. For example, four level sensors 16, 17, 18, 19 are installed one by one from the upper side to the lower side of the tank 11 so as to check the amount of slurry remaining inside the tank 11. When slurry is exhausted down to the level of the third or the fourth level sensor 18 or 19, new slurry is supplied through the supplementary line 15 and return line 14 until the top surface of the slurry reaches the level of the first or the second level sensors 16 or 17.

Generally, the empty volume between the top inside surface of the tank 11 and the top surface of the slurry in the tank is filled with air or nitrogen. However, in the above slurry distribution system, slurry residue, which becomes hardened and lumped due to the distortion of the slurry, forms on the bottom of the tank 11. When the distorted and lumped slurry residue enters the CMP equipment through the slurry supply line 11 according to the flow movement inside the tank 11, it causes fine scratches on the wafers while performing the CMP process.

These scratches cause malfunctioning of the semiconductor devices and deterioration of their qualities. This kind of problem is more serious with highly integrated semiconductor devices.

In order to prevent the distorted and lumped slurry residue from entering into the CMP equipment, filters are installed in the slurry distribution system or supply pipes of the CMP equipment, but scratches are not completely prevented because the slurry residue also shortens the life of the filters.

The distorted and lumped slurry residue can be found in many areas of the slurry supply system, including the return line 14, the inside wall of the tank 11, etc., and is more thickly distributed closer to the bottom of the tank 11 because of its weight.

As shown in FIG. 1, the lower opening 12*a* of the slurry supply line 12 is very close to the bottom of the tank 11 in order to supply as much of the slurry in the tank 11 to the CMP equipment as possible. The distance H between the opening 12*a* of the slurry supply line 12 and the bottom of the tank 11 is generally less than 5 cm, and therefore, the distorted and lumped slurry residue on the bottom of the tank 11 enters the supply line 12 and proceeds into the CMP equipment according to the slurry flow path in the system.

SUMMARY OF THE INVENTION

An object of the present invention is to provide a slurry distribution system which prevents the distorted or lumped slurry residue from entering into the CMP equipment as much as possible by locating the open end of the slurry supply line near the top surface of the slurry so that pure and clean slurry is supplied into the CMP equipment.

To achieve this and other advantages and in accordance with the purpose of the present invention, as embodied and broadly described, the slurry distribution system for supplying the slurry inside a tank to CMP equipment includes a movable supply line inserted through an opening in the top of the tank. The open end of the movable supply line is located below the surface of the slurry by a predetermined distance. A flexible connecting means connects the other end of the movable supply line located outside the tank to a fixed main supply line which leads to the CMP equipment and allows the movable supply line to move vertically. A position-controlling means controls the vertical movement of the movable supply line such that the open end of the movable supply line remains below the top surface of the slurry by a predetermined distance, by moving the movable supply line vertically according to the flow of slurry inside the tank.

A guide is further installed at the opening on the top of the tank to guide the vertical movement of the movable supply line. The flexible connecting means is preferably formed of pleated tubing which is itself flexibly movable. The position-controlling means is preferably formed with a float which always floats on the top surface of the slurry and is fixed near the open end of the movable supply line.

In a further embodiment, the position-controlling means includes a detecting sensor located near the open end of the movable supply line, which outputs an on/off signal selectively responsive to changes in the distance between the slurry surface and the sensor itself. For example, when this distance exceeds a predetermined distance or when the sensor touches the slurry surface, a driving means placed outside the tank vertically moves the movable supply line. A driving-control means drives the driving means for a specified time in accordance with the on/off signals output from the detecting sensor.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings illustrate embodiments of the invention and the prior art, in which.

DETAILED DESCRIPTION OF PREFERRED EMBODIMENTS

Figure 1:
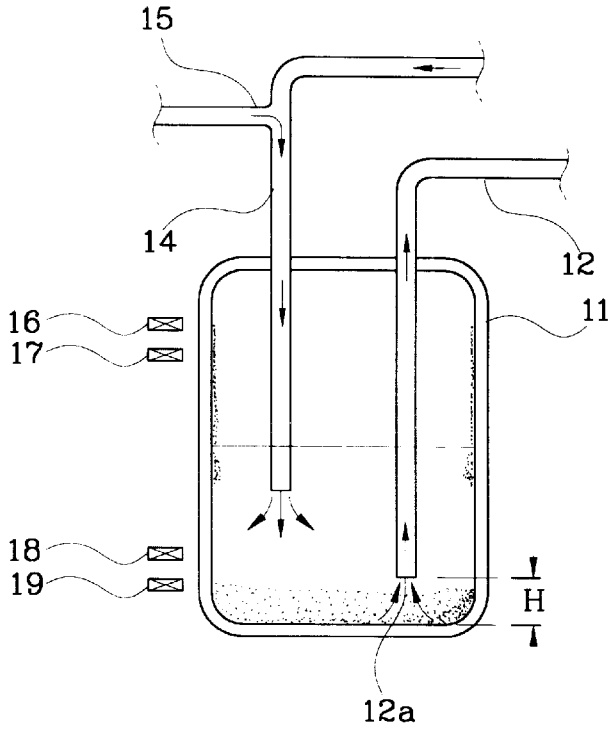
FIG. 1 (PRIOR ART)
FIG. 1 is a schematic view of a conventional slurry distribution system for a CMP process.

Reference will now be made in detail to the preferred embodiments of the present invention, examples of which are illustrated in the accompanying drawings. Like reference numerals indicate like structural elements throughout.

Figure 2:
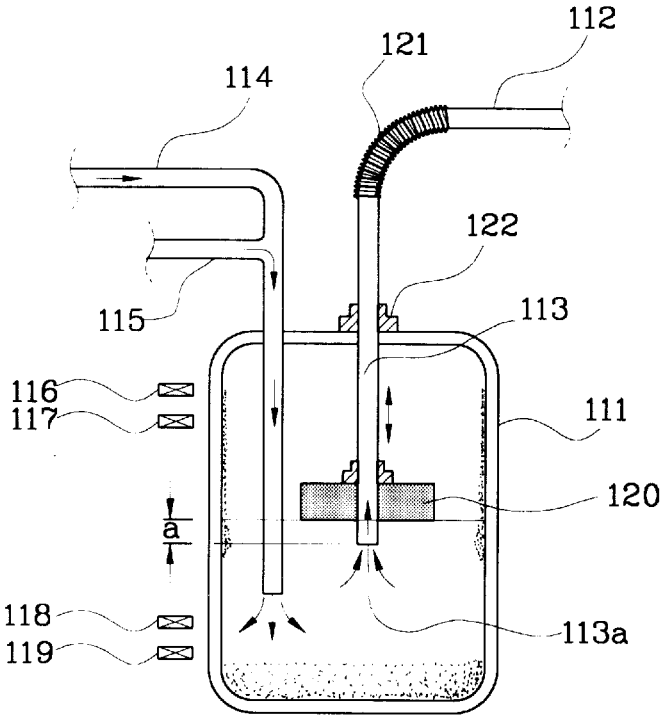
FIG. 2 is a schematic view of a first embodiment of the slurry distribution system for a CMP process according to the present invention.

FIG. 2 shows a slurry distribution system of the semiconductor CMP process according to the present invention. The slurry distribution system includes a tank 111 that stores a certain amount of slurry and a movable supply line 113 that penetrates the top of the tank 111. An open end 113*a* of the movable supply line 113 is submerged in the slurry inside the tank 111 and is maintained at a predetermined distance below the top surface of the slurry by a position-controlling means. The other end of the movable supply line is located outside the tank 111 and is connected to a main supply line 112 by flexible connecting means 121 in order to supply slurry into the CMP equipment. The vertical movement of the movable supply line 113 is controlled by the position-controlling means.

In this embodiment the position-controlling means is a float 120 that is fixed on the movable supply line 113 near open end 113*a* and that always floats on the top surface of the slurry. Open end 113*a* of the movable supply line 113 is located below the bottom of the float 120 and is always submerged below the top surface of the slurry by a predetermined depth 'a'. The float 120 is preferably formed with a buoyant bladder.

The movable supply line 113 vertically moves with the float 120 in accordance with the rise and fall of the top surface of the slurry as the amount of slurry in the tank increases and decreases. The open end 113*a* of the movable supply line 113 thus remains submerged below the top surface of the slurry by the predetermined depth 'a' even as the amount of the slurry increases and decreases.

The flexible connecting means 121 is preferably formed of flexible pleated tubing, and the flexible pleated tubing allows the movable supply line 113 to vertically move relative to the generally fixed installed main supply line 112. A guide 122 is installed on the top of the tank 111 so as to support the movable supply line 113 where it penetrates the tank 111 and help the vertical movement of the movable supply line 113.

A return line 114 also enters the top of the tank 111, through which any excess circulating slurry not used in the CMP equipment is returned to the tank 111. The return line 114 has a supplementary line 115 connected thereto at a point outside of tank 111. The supplementary line 115 supplies new slurry from a slurry mixing tank (not shown) to tank 111.

Tank 111 is equipped with a plurality of level sensors 116, 117, 118, 119 in order to sense the level of the slurry in the tank 111, so as to always maintain the amount of slurry in the tank 111 within a certain range. For example, four level sensors 116, 117, 118, 119 are installed one by one from the upper side to the lower side of the tank 111 so as to sense the amount of slurry inside the tank 111. When slurry is exhausted down to the level of the third or the fourth level sensor 118 or 119, new slurry is supplied through the return line 114 into the tank 111 until its top surface reaches the level of the first or the second level sensor 116 or 117, after which the new slurry supply stops.

When the top surface of the slurry is raised, the float 120 and its connected movable supply line 113 are raised because the float 120 always floats on the top surface of the slurry due to its buoyancy. The pleated tubing 121 is compressed as the movable supply line 113 moves upwardly such that the open end 113*a* of the movable supply line 113 remains at the predetermined depth 'a' from the top surface of the slurry.

Figure 3:
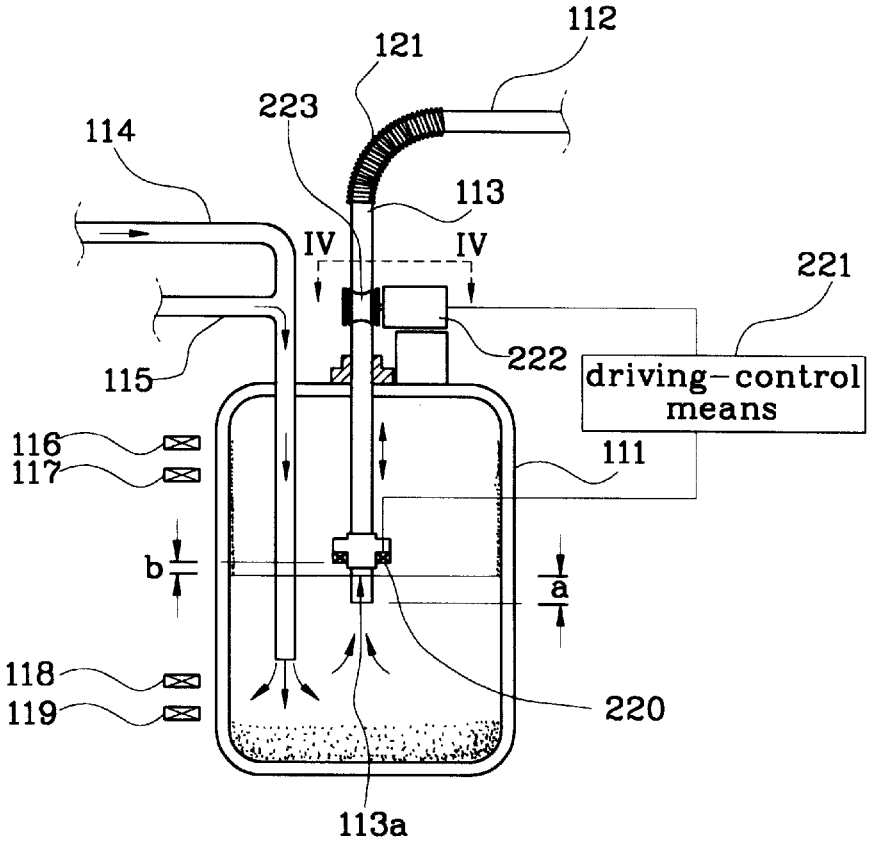
FIG. 3 is a schematic view of a second embodiment of the slurry distribution system for a CMP process according to the present invention.

FIG. 3 shows another embodiment of the position-controlling means of the slurry distribution system for a semiconductor CMP process according to the present invention. A detecting sensor 220 is fixed on one end of the movable supply line 113 near the open end 113*a*, inside the tank 111, and the detecting sensor 220 outputs an "on" signal when a predetermined distance 'b' between the detecting sensor 220 and the top surface of the slurry has been exceeded. When the detecting sensor 220 touches the top surface of the slurry, it outputs an "off" signal.

Outside the tank 111, a driving means is installed on the movable supply line 113 in order to move the movable supply line 113 up and down in accordance with the on/off signal output from the detecting sensor 220. The on/off signal from the detecting sensor 220 is input to a driving-control means 221 which controls the driving means.

The detecting sensor 220 is preferably formed with a float-type sensor, and the driving means comprises a reversible driving motor 222 with a driving roller 223 and a driven roller 224 for moving the movable supply line 113 up and down.

Figure 4:
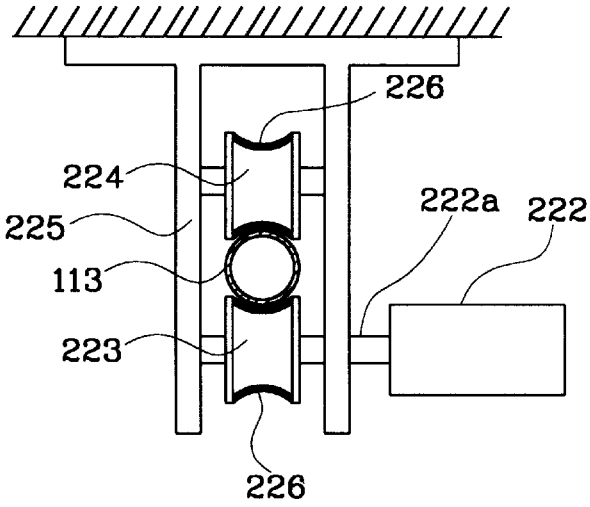
FIG. 4 is a cross-sectional view taken along line IV—IV of FIG. 3.

As shown in FIG. 4, the driving roller 223 and the driven roller 224 are installed rotatably in a fixing frame 225 having movable supply line 113 located with a friction fit between them such that the movable supply line 113 is slightly compressed from both sides. The driving roller 223 is fixed on a shaft 222*a* of the driving motor 222.

The driving roller 223 is rotated in a normal direction or a reverse direction by the driving motor 222, and so the movable supply line 113 is moved up and down between the driving roller 223 and the driven roller 224 in accordance with the rotation direction of the driving roller 223.

In order to increase the friction fit between the movable supply line 113 and the driving roller 223 and the driven roller 224, the peripheral areas of the driving roller 223 and the driven roller 224 which contact the movable supply line 113 preferably have a concave shape which corresponds to the convex outer surface of the movable supply line 113. Generally, the cross-sectional shape of the movable supply line 113 is a circle, and the cross-sectional shapes of the peripheral areas of the driving roller 223 and the driven roller 224 are semicircular or arcuate.

The peripheral edges of the driving roller 223 and the driven roller 224 which contact the movable supply line 113 may be equipped with a band 226 which is made of rubber, or the driving roller 223 and the driven roller 224 may themselves be made of rubber.

When slurry is pumped from the tank 111 into the CMP equipment, the top surface of the slurry is lowered, and the detecting sensor 220 outputs an "on" signal because the distance between the detecting sensor 220 and the top surface of the slurry has exceeded the predetermined distance 'b'. Thereafter the driving motor 222 is driven to move the movable supply line 113 downward.

More specifically, when the distance between the top surface of the slurry and the detecting sensor exceeds the predetermined distance 'b', the detecting sensor 220 outputs the 'on' signal, and accordingly, the driving-control means 221 recognizes the lowering of the top surface of the slurry. Then, the driving motor 222 immediately starts to drive the driving roller 223 for a specified time, and then stops driving the driving roller 223 at the end of that specified time.

Therefore, the driving roller 223 is rotated in a direction that moves the movable supply line 113 downwardly for the specified time so that the movable supply line 113 moves downwardly a certain length by the friction of the driving roller 223 and the driven roller 224. The movable supply line 113 stops moving at the same time the driving motor 222 stops.

The certain length that the movable supply line 113 moves downwardly is preferably set such that the open end 113*a* of the movable supply line 113 always remains a predetermined depth 'a' from the top surface of the slurry. Notice that the predetermined depth 'a' between the open end 113*a* and the top surface of the slurry is set to be greater than the predetermined distance 'b' between the detecting sensor 220 and the top surface of the slurry so that the open end 113*a* will remain immersed in the slurry even when the distance between the detecting sensor 220 and the top surface of the slurry is beyond the predetermined length 'b'.

Therefore, when the top surface of the slurry is lowered, the open end 113*a* is lowered responsive thereto so that the opening 113*a* is always located below the top surface of the slurry by the predetermined depth 'a'.

Meanwhile, when the top surface of the slurry is lowered to the level of the third level sensor 118 or the fourth level sensor 119, new slurry is supplied through the return line 114 into the tank 111, thereby raising the top surface of the slurry inside the tank 111. In addition, if the top surface of the slurry touches the detecting sensor 220, an 'off' signal is output from the detecting sensor 220 so that the movable supply line 113 moves upwardly by the driving action of the driving motor 222.

In other words, if an 'off' signal is output from the detecting sensor 220 and received by the driving-control means 221, the driving-control means 221 recognizes the rise in the slurry surface and drives the driving motor 222 for a specified time and stops its driving after the specified time.

The driving roller 223 is rotated in a direction which is the reverse of the direction that moved the movable supply line 113 downwardly. The driving roller 223 is driven in this reverse direction by the driving of the driving motor 222 for a specified time, such that the movable supply line 113 moves upwardly a certain length due to the friction of the driving roller 223 and the driven roller 224. The movable supply line 113 stops moving when the driving motor 222 stops.

Here, the movable supply line 113 should not be moved upwardly beyond the point that the distance between the detecting sensor 220 and the top surface of the slurry exceeds the predetermined distance 'b', so that the open end 113*a* remains below the top surface of the slurry by the predetermined depth 'a'.

By the manner described above, the top surface of the slurry is raised and the level of the open end 113*a* is also raised so as to keep the distance between the top surface of the slurry and the open end 113*a* uniform. When the top surface of the slurry is raised, and reaches the first or the second level sensor 116, 117, the supplementary supply of new slurry stops.

While preferred embodiments of the present invention have been described, it will be understood by those skilled in the art that various changes and modifications may be made, and equivalents may be substituted for elements thereof without departaing from the true scope of the present invention. Therefore, it is intended that the present invention not be limited to the particular embodiments disclosed, but that the present invention include all embodiments falling within the scope of the appended claims.

What is claimed is:

1. A slurry distribution system for supplying slurry to CMP equipment, comprising:

a tank for storing the slurry;

a movable supply line inserted through an opening in a top of said tank, said movable supply line being supported for vertical movement in said opening, said movable supply line having a first open end located inside said tank, and a second end located outside said tank and opposite to said first open end;

flexible connecting means connecting said second end of said movable supply line to a fixed main supply line which is connected to said CMP equipment, said flexible connecting means allowing said movable supply line to move vertically relative to said fixed main supply line and said tank; and position-controlling means controlling vertical movement of said movable supply line in accordance with rise and fall of a top surface of the slurry in the tank, such that said first open end of said movable supply line remains below the top surface of the slurry by a predetermined distance.

2. The slurry distribution system as claimed in claim 1, further comprising a guide installed at said opening in the top of said tank, said guide providing support for vertical movement of said movable supply line.

3. The slurry distribution system as claimed in claim 1, wherein said flexible connecting means comprises pleated tubing.

4. The slurry distribution system as claimed in claim 1, wherein said position-controlling means comprises a float which floats on the top surface of the slurry and is fixed on said movable supply line near said first open end.

5. The slurry distribution system as claimed in claim 4, wherein said first open end of said movable supply line extends below a bottom of said float, such that said first open end is submerged in the slurry.

6. The slurry distribution system as claimed in claim 4, wherein said float is a buoyant bladder.

7. The slurry distribution system as claimed in claim 1, wherein said position-controlling means comprises:

a detecting sensor attached to said movable supply line near said first open end, said detecting sensor selectively outputting an on/off signal when a distance between said detecting sensor and the top surface of the slurry exceeds a predetermined distance and when said detecting senor touches the top surface of the slurry;

driving means placed outside the tank for vertically moving said movable supply line; and driving-control means for driving said driving means for a specified time in accordance with said on/off signals output from said detecting sensor.

8. The slurry distribution system as claimed in claim 7, wherein said first open end of said movable supply line extends below a bottom of said detecting sensor, such that said first open end is submerged in the slurry.

9. The slurry distribution system as claimed in claim 7, wherein said driving means comprises:

a driving roller and a driven roller which are rotatably installed in a fixing frame, said movable supply line being installed with a friction fit between said driving and driven rollers; and a driving motor for rotating said driving roller, said driving motor having a shaft onto which said driving roller is fixed.

10. The slurry distribution system as claimed in claim 9, wherein peripheral areas of said driving roller and said driven roller which contact said movable supply line have cross-sectional shapes which confront a cross-sectional shape of an outer surface of said movable supply line.

11. The slurry distribution system as claimed in claim 10, wherein said peripheral areas of said driving and driven rollers have concave arcuate cross-sectional shapes, and said outer surface of said movable supply line has a circular cross-sectional shape.

12. The slurry distribution system as claimed in claim 10, wherein said peripheral areas of said driving roller and said driven roller are equipped with a band made of rubber.

13. The slurry distribution system as claimed in claim 10, wherein said driving and driven rollers are made of rubber.

14. The slurry distribution system as claimed in claim 7, wherein the predetermined distance between said detecting sensor and the top surface of the slurry is less than the predetermined distance between said first open end and the top surface of the slurry.

* * * * *